US008905145B2

(12) United States Patent
Napier

(10) Patent No.: US 8,905,145 B2
(45) **Date of Patent: *Dec. 9, 2014**

(54) REMOTE AND MANUAL ACTUATED WELL TOOL

(75) Inventor: Rory Archibald Napier, Montrose (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/879,007

(22) PCT Filed: Jun. 26, 2012

(86) PCT No.: PCT/EP2012/062391

§ 371 (c)(1),
(2), (4) Date: Dec. 17, 2013

(87) PCT Pub. No.: WO2014/000777

PCT Pub. Date: Jan. 3, 2014

(65) Prior Publication Data

US 2014/0096976 A1 Apr. 10, 2014

(51) Int. Cl.

| | |
|---|---|
| ***E21B 34/14*** | (2006.01) |
| ***E21B 41/00*** | (2006.01) |
| ***E21B 47/12*** | (2012.01) |

(52) U.S. Cl.

CPC ..... *E21B 34/14* (2013.01); *E21B 41/00* (2013.01); *E21B 47/12* (2013.01)

USPC ..... 166/373; 166/332.4

(58) Field of Classification Search

CPC ..... E21B 34/14; E21B 34/12

USPC ..... 166/377, 332.4, 334.2, 373

See application file for complete search history.

(56) References Cited

U.S. PATENT DOCUMENTS

| | | | |
|---|---|---|---|
| 3,696,868 | A | 10/1972 | Taylor, Jr. |
| 3,882,935 | A | 5/1975 | Calhoun |

(Continued)

FOREIGN PATENT DOCUMENTS

| | | |
|---|---|---|
| NO | 313108 | 5/1997 |

OTHER PUBLICATIONS

Notification of Transmittal of the International Search Report and the Written Opinion of the International Search Authority, or the Declaration (1 page); International Search Report (3 pages); and Written Opinion of the International Search Authority (6 pages), mailed Mar. 14, 2013, in corresponding international application PCT/EP2012/062391.

(Continued)

*Primary Examiner* — David Andrews

(74) *Attorney, Agent, or Firm* — Scott Richardson; Fish & Richardson P.C.

(57) ABSTRACT

A well tool having an actuator sleeve in a housing. The actuator sleeve has an internal shifting tool engaging profile. The tool has an actuator in the housing that is responsive to a remote signal to change from an unactuated state to an actuated state and shift the actuator sleeve from a first position to a second position. A collet in the housing is supported to couple the actuator sleeve to the actuator while the actuator changes from the unactuated state to the actuated state and is unsupported to allow the actuator sleeve to move relative to the actuator when the actuator is in the actuated state.

26 Claims, 6 Drawing Sheets

(56) References Cited

U.S. PATENT DOCUMENTS

| | | | |
|---|---|---|---|
| 3,886,967 | A | 6/1975 | Nelson |
| 3,896,876 | A | 7/1975 | Crowe |
| 3,912,008 | A | 10/1975 | Crowe |
| 3,939,913 | A | 2/1976 | Mott |
| 3,955,624 | A | 5/1976 | Fredd et al. |
| 4,344,602 | A | 8/1982 | Arendt |
| 4,417,600 | A | 11/1983 | Kohn |
| 4,420,041 | A | 12/1983 | Patel |
| 4,425,965 | A | 1/1984 | Bayh, III et al. |
| 4,436,157 | A | 3/1984 | Brooks |
| 4,449,587 | A | 5/1984 | Rodenberger et al. |
| 4,522,370 | A | 6/1985 | Noack et al. |
| 4,552,219 | A | 11/1985 | Wong et al. |
| 4,603,740 | A | 8/1986 | Edwards et al. |
| 4,603,742 | A | 8/1986 | Wong et al. |
| 4,605,070 | A | 8/1986 | Morris |
| 4,624,315 | A | 11/1986 | Dickson et al. |
| RE32,343 | E | 2/1987 | Vinzant et al. |
| 4,657,082 | A | 4/1987 | Ringgenberg |
| 4,664,195 | A | 5/1987 | Deaton |
| 4,667,736 | A | 5/1987 | Rumbaugh et al. |
| 4,703,805 | A | 11/1987 | Morris |
| 4,723,606 | A | 2/1988 | Vinzant et al. |
| 4,749,043 | A | 6/1988 | Rodenberger |
| 4,834,175 | A | 5/1989 | Ross et al. |
| 4,834,183 | A | 5/1989 | Vinzant et al. |
| 4,903,775 | A | 2/1990 | Manke |
| 4,934,652 | A | 6/1990 | Golden |
| 4,944,345 | A | 7/1990 | Mashaw, Jr. |
| 4,945,993 | A | 8/1990 | Dickson et al. |
| 4,979,569 | A | 12/1990 | Anyan et al. |
| 4,997,038 | A | 3/1991 | Welch |
| 5,022,427 | A | 6/1991 | Churchman et al. |
| 5,050,839 | A | 9/1991 | Dickson et al. |
| 5,141,023 | A | 8/1992 | Dollison et al. |
| 5,518,073 | A | 5/1996 | Manke et al. |
| 5,810,087 | A | 9/1998 | Patel |
| 5,826,661 | A | 10/1998 | Parker et al. |
| 5,950,733 | A | 9/1999 | Patel |
| 6,085,845 | A | 7/2000 | Patel et al. |
| 6,230,807 | B1 | 5/2001 | Patel |
| 6,321,847 | B1 | 11/2001 | Brown |
| 7,438,130 | B2 | 10/2008 | Read, Jr. |
| 2009/0266544 | A1 | 10/2009 | Redlinger |
| 2009/0294124 | A1 | 12/2009 | Patel |
| 2011/0042107 | A1* | 2/2011 | Chambers et al. ..... 166/386 |
| 2012/0067594 | A1 | 3/2012 | Noske et al. |
| 2013/0213673 | A1* | 8/2013 | Crabb et al. ..... 166/386 |

OTHER PUBLICATIONS

Otis Engineering Corporation, "Series 10® Flapper-Type Valves" 1989 (2 pages).

Otis Engineering Corporation, Otis Remote-Controlled Wireline-Retrievable Tubing Safety Valves (Storm Choke®) 1974-75 Catalog (2 pages).

Halliburton, "FS2 Fluid Loss Isolation Barrier Valve" Completion Tools, May 2012 (2 pages).

Halliburton, "FS2 Valve" Completion Tolls, Mar. 2010 (1 page).

* cited by examiner

REMOTE AND MANUAL ACTUATED WELL TOOL

REFERENCE TO RELATED APPLICATION

This application is a National Stage application of, and claims the benefit of priority to, PCT/EP2012/062391, filed Jun. 26, 2012, the entirety of which is incorporated by reference herein.

BACKGROUND

This disclosure relates to remotely and mechanically actuated tools for use in subterranean well systems.

There are numerous tools for use in a subterranean well that can be remotely actuated by a hydraulic, electric, and/or other type of signal generated remote from the tool. Some of these tools further include provisions for mechanical actuation, for example, by a shifting tool manipulated from the surface. The mechanical actuation provides an alternative or contingency mode of actuation apart from actuation in response to the remote signal. In actuating the tool manually, however, the shifting tool must overcome the remote actuator mechanism or the remote actuator mechanism must be uncoupled from the actuated element of the tool.

DESCRIPTION OF DRAWINGS

FIG. 2A shows the example valve in an open position. FIG. 2B shows the example valve in a closed position.

FIG. 3 is a half cross-sectional view with an actuator assembly of the valve unactuated and the valve closure open. FIG. 4A is a quarter sectional view showing the actuator assembly changing from an unactuated to an actuated state. FIG. 4B is a quarter sectional view showing the actuator assembly in the actuated state.

Like reference symbols in the various drawings indicate like elements.

DETAILED DESCRIPTION

Figure 1:
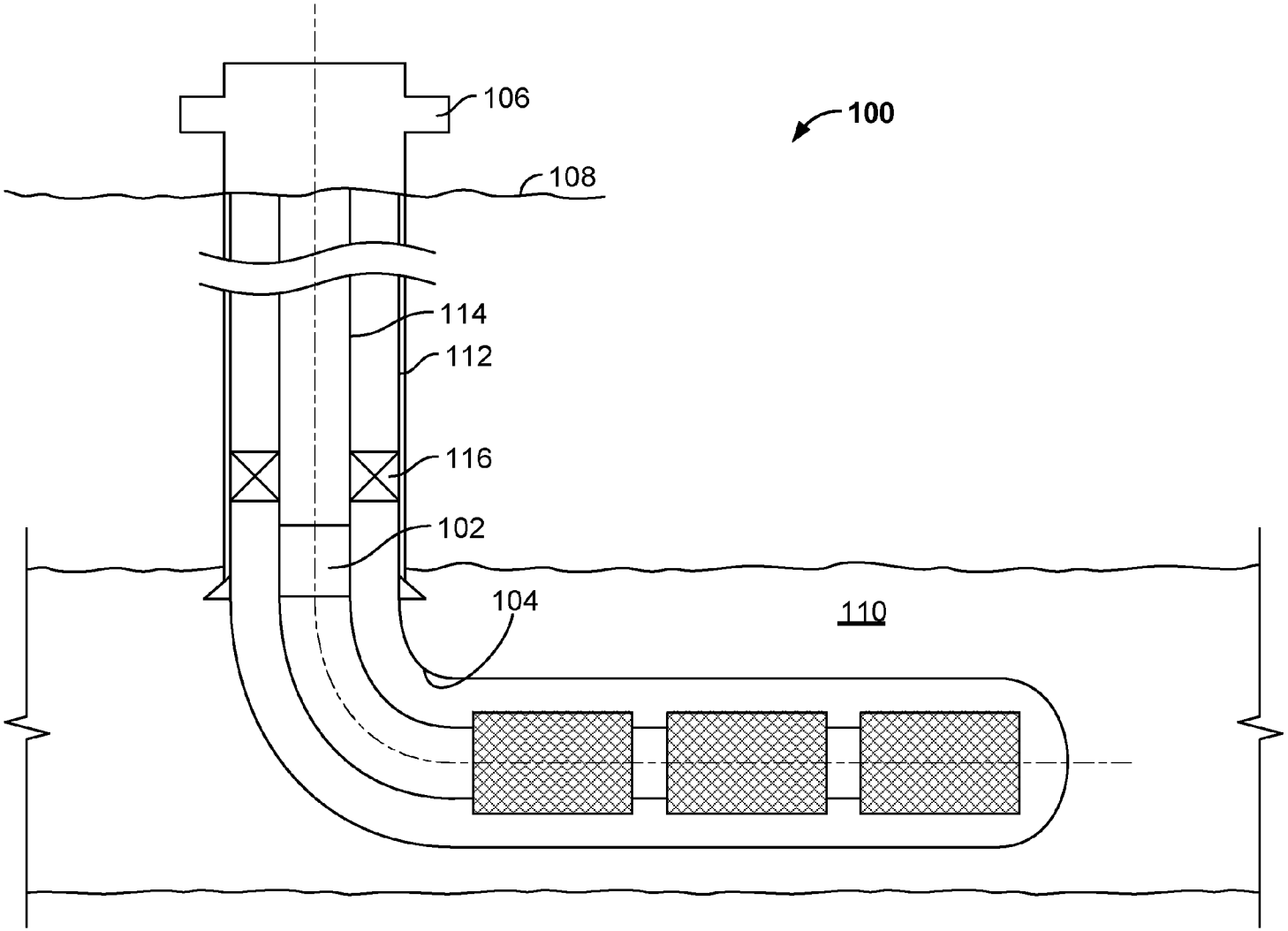
FIG. 1 is a side cross-sectional view of an example well system.

FIG. 1 is a side cross-sectional view of a well system 100 with an example valve 102 constructed in accordance with the concepts herein. The well system 100 is provided for convenience of reference only, and it should be appreciated that the concepts herein are applicable to a number of different configurations of well systems. As shown, the well system 100 includes a substantially cylindrical well bore 104 that extends from well head 106 at a terranean surface 108 through one or more subterranean zones of interest 110. In FIG. 1, the well bore 104 extends substantially vertically from the surface 108 and deviates to horizontal in the subterranean zone 110. However, in other instances, the well bore 104 can be of another configuration, for example, entirely substantially vertical or slanted, it can deviate in another manner than horizontal, it can be a multi-lateral, and/or it can be of another configuration.

The well bore 104 is lined with a casing 112, constructed of one or more lengths of tubing, that extends from the well head 106 at the surface 108, downhole, toward the bottom of the well 104. The casing 112 provides radial support to the well bore 104 and seals against unwanted communication of fluids between the well bore 104 and surrounding formations. Here, the casing 112 ceases at the subterranean zone 110 and the remainder of the well bore 104 is an open hole, i.e., uncased. In other instances, the casing 112 can extend to the bottom of the well bore 104 or can be provided in another configuration.

A completion string 114 of tubing and other components is coupled to the well head 106 and extends, through the well bore 104, downhole, into the subterranean zone 110. The completion string 114 is the tubing that is used, once the well is brought onto production, to produce fluids from and inject fluids into the subterranean zone 110. Prior to bringing the well onto production, the completion string is used to perform the final steps in constructing the well. The completion string 114 is shown with a packer 116 above the subterranean zone 110 that seals the annulus between the completing string 114 and casing 112, and directs fluids to flow through the completion string 114 rather than the annulus.

The example valve 102 is provided in the completion string 114 below the packer 116. The valve 102 when open, allows passage of fluid and communication of pressure through the completion string 114. When closed, the valve 102 seals against passage of fluid and communication of pressure between the lower portion of the completion string 114 below the valve 102 and the upper portion of the completion string 114. The valve 102 has provisions for both mechanical and remote operation. As described in more detail below, for mechanical operation, the valve 102 has an internal profile that can be engaged by a shifting tool to operate the valve. For remote operation, the valve 102 has a remote actuator assembly that responds to a signal (e.g., a hydraulic, electric, and/or other signal) to operate the valve. The signal can be generated remote from the valve 102, for example at the surface.

In the depicted example, the valve 102 is shown as a fluid isolation valve that is run into the well bore 104 open, mechanically closed with a shifting tool and then eventually re-opened in response to a remote signal. The valve 102, thus allows an operator to fluidically isolate the subterranean zone 110, for example, while an upper portion of the completion string 114 is being constructed, while subterranean zones above the valve 102 are being produced (e.g., in a multi-lateral well), and for other reasons. The concepts herein, however, are applicable to other configurations of valves. For example, the valve 102 could be configured as a safety valve. A safety valve is typically placed in the completion string 114 or riser (e.g., in a subsea well), and is biased closed and held open by a remote signal. When the remote signal is ceased, for example, due to failure of the well system above the valve 102, the valve 102 closes. Thereafter, the valve 102 is mechanically re-opened to recommence operation of the well.

Figure 2A:
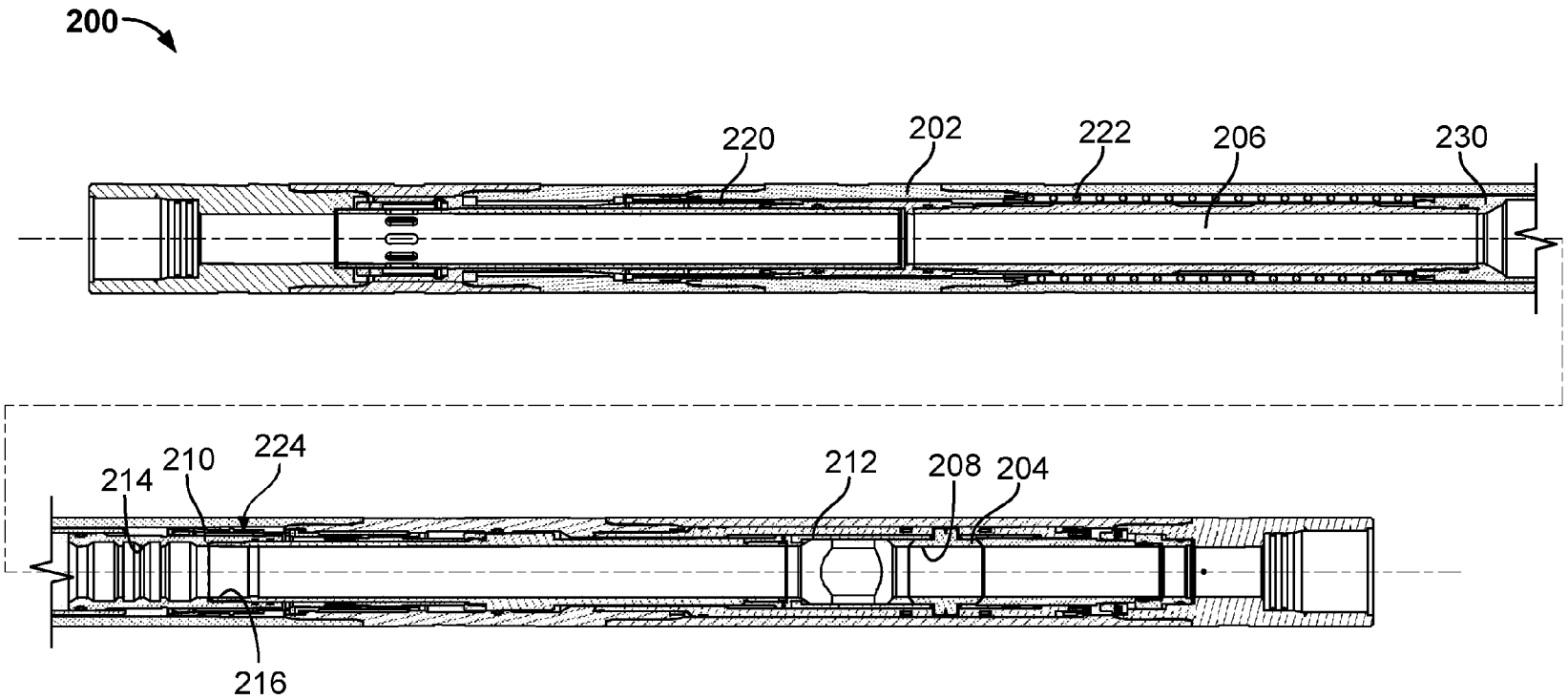
FIGS. 2A and 2B are detail side cross-sectional views of an example valve.
Figure 2B:
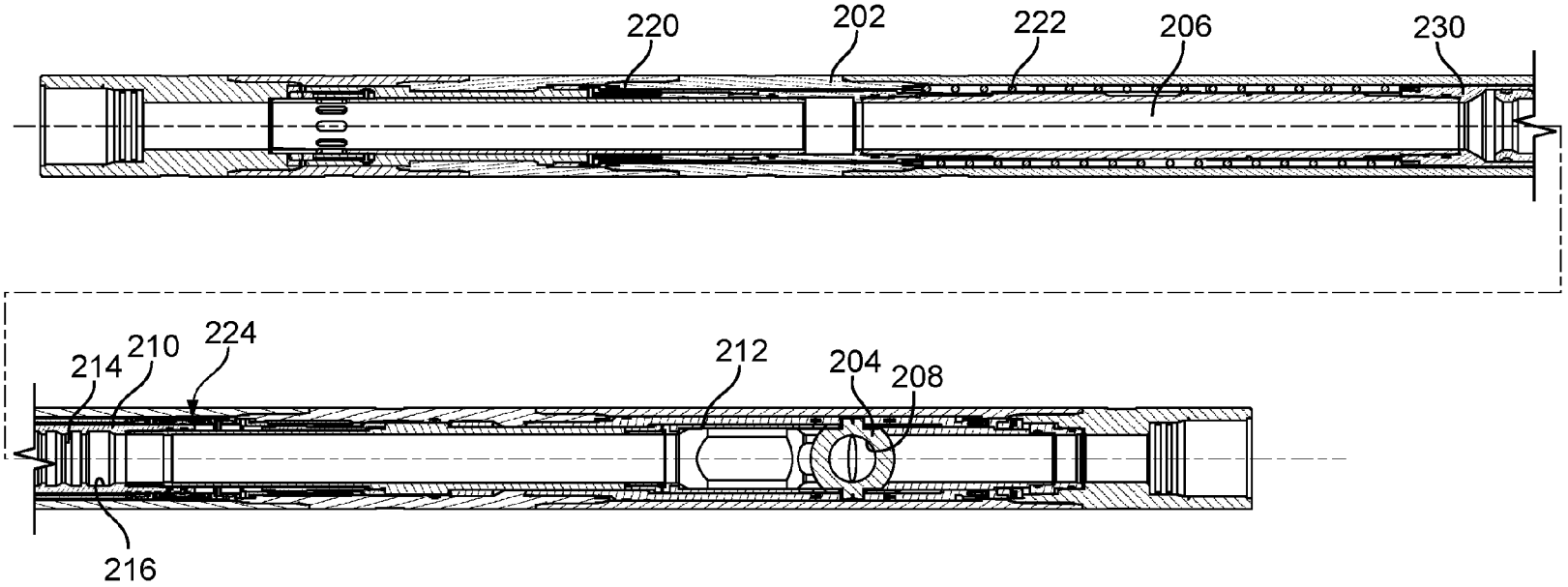

Turning now to FIGS. 2A and 2B, an example valve 200 is depicted in half side cross-section. The example valve 200 can be used as valve 102. The valve 200 includes an elongate, tubular valve housing 202 that extends the length of the valve 200. The housing 202 is shown as made up of multiple parts for convenience of construction, and in other instances, could be made of fewer or more parts. The ends of the housing 202 are configured to couple to other components of the completion string (e.g., threadingly and/or otherwise). The components of the valve 200 define an internal, cylindrical central bore 206 that extends the length of the valve 200. The central bore 206 is the largest bore through the valve 200 and corresponds in size to the central bore of the remainder of the completion string. The housing 202 contains spherical ball-type valve closure 204 that, likewise, has a cylindrical, central bore 208 that is part of and is the same size as the remainder of the central bore 206. The valve closure 204 is carried to rotate about an axis transverse to the longitudinal axis of the valve housing 202. The valve 200 is open when the central bore 208 of the valve closure 204 aligns with and coincides with the central bore 206 of the remainder of the valve 200 (FIG. 2A). The valve 200 is closed when the central bore 208 of the valve closure 204 does not coincide with, and seals against passage of fluid and pressure through, the central bore 206 of the remainder of the valve 200 (FIG. 2B). In other instances, the valve closure 204 can be another type of valve closure, such as a flapper and/or other type of closure.

The valve closure 204 is coupled to an elongate, tubular actuator sleeve 210 via a valve fork 212. The actuator sleeve 210 is carried in the housing 202 to translate between an uphole position (to the left in FIG. 2B) and a downhole position (to the right in FIG. 2A), and correspondingly move the valve fork 212 between an uphole position and a downhole position. When the actuator sleeve 210 (and valve fork 212) are in the uphole position, the valve closure 204 is in the closed position. As the actuator sleeve 210 (and valve fork 212) translates to the downhole position, the valve closure 204 rotates around the transverse axis to the open position.

The valve 200 has provisions for remote operation to operate the valve closure 204 in response to remote signal (e.g., a hydraulic, electric, and/or other signal). To this end, the valve 200 has a remote actuator assembly 220 that is coupled to the actuator sleeve 210. The actuator assembly 220 is responsive to the remote signal to shift the actuator sleeve 210 axially and change the valve between the closed and open positions. While the actuator assembly 220 can take a number of forms, depending on the desired operation of the valve, in certain instances of the valve 200 configured as a fluid isolation valve, the actuator assembly 220 is responsive to a specified number of pressure cycles (increase and decrease) provided in the central bore 208 to release compressed power spring 222 carried in the housing 202 and coupled to the actuator sleeve 210. FIG. 2A shows the actuator assembly 220 in an unactauted state with the power spring 222 compressed. FIG. 2B shows the actuator assembly 220 in the actuated state with the power spring 222 expanded. As seen in the figure, the released power spring 222 expands, applies load to and moves the actuator sleeve 210 axially from the uphole position to the downhole position, and thus changes the valve closure 204 from the closed position to the open position. In some implementations, a stop spring mandrel 230 carried with the power spring 222 outputs the actuation loads and axial movement from the actuator assembly 220 (i.e., outputs the force and movement of the power spring 222). The pressure cycles are a remote signal in that they are generated remotely from the valve 200, for example, by repeatedly opening and closing a valve in the completion string at the surface, for example, in the well head. One example of such an actuator assembly can be found on the fluid loss isolation barrier valve sold under the trade name FS by Halliburton Energy Services, Inc.

The valve 102 has provisions for mechanical operation to allow operating the valve closure 204 with a shifting tool inserted through the central bore 206. To this end, the actuator sleeve 210 has a profile 214 on its interior bore 216 that is configured to be engaged by a corresponding profile of the shifting tool. The profile 214 enables the shifting tool to grip the actuator sleeve 210 and move it between the uphole position and the downhole position, thus operating the valve closure 204. In the present example, the uphole position corresponds to the valve closure 204 being in the fully closed position and the downhole position corresponds to the valve closure 204 being the fully open position. The shifting tool can be inserted into the valve 200 on a working string of tubing and other components inserted through the completion string from the surface. One example of such an actuator sleeve and shifting tool are those sold with the fluid loss isolation barrier valve sold under the trade name FS by Halliburton Energy Services, Inc. However, other tools capable of gripping the internal profile and manipulating the actuator sleeve 210 could be used.

To facilitate mechanical operation of the valve 200 when the actuator assembly 220 has been actuated, the actuator sleeve 210 can be uncoupled from the remote actuator assembly 220. Uncoupling the actuator sleeve 210 from the remote actuator assembly 220 reduces the amount of force the shifting tool must apply to move the actuator sleeve 210. For example, in a configuration having a power spring 222, if the actuator sleeve 210 is uncoupled from the remote actuator assembly 220, the shifting tool does not have to compress the power spring 222. Thus, the remote actuator assembly 220 is releasably coupled to the actuator sleeve 210 via a releasable coupling assembly 224. In some implementations, one or more collets in the housing are supported to couple the actuator sleeve 210 and the actuator assembly 220 while the actuator assembly 220 changes from the unactuated state to the actuated state. When the actuator assembly 220 reaches the actuated state, the collet is unsupported to uncouple the actuator assembly 220 and actuator sleeve 210 and allow the actuator sleeve 210 to move relative to the actuator assembly 220.

Additionally, in certain instances, the interface between the actuator assembly 220 and the actuator sleeve 210 can be configured to allow mechanical operation of the valve 200 when the actuator assembly 220 is in the unactuated state, prior to actuation. In one example, the releasable coupling assembly 224 can couple to the actuator sleeve 210 in a manner that, with the actuator assembly 220 in the unactuated state and the collet supported to couple the actuator sleeve 210 to the actuator assembly 220, the actuator sleeve 210 is able to move between the uphole position and the downhole position, thus opening and closing the valve closure 204.

The valve 200 can thus be installed in the well bore and operated manually, with a shifting tool, to open and close multiple times, and as many times as is needed. Thereafter, the valve 200 can be left in a closed state and remotely operated to an open state via a remote signal. After being opened by the remote signal, the valve 200 can again be operated manually, with a shifting tool, to open and close multiple times, as many times as is needed.

Figure 3:
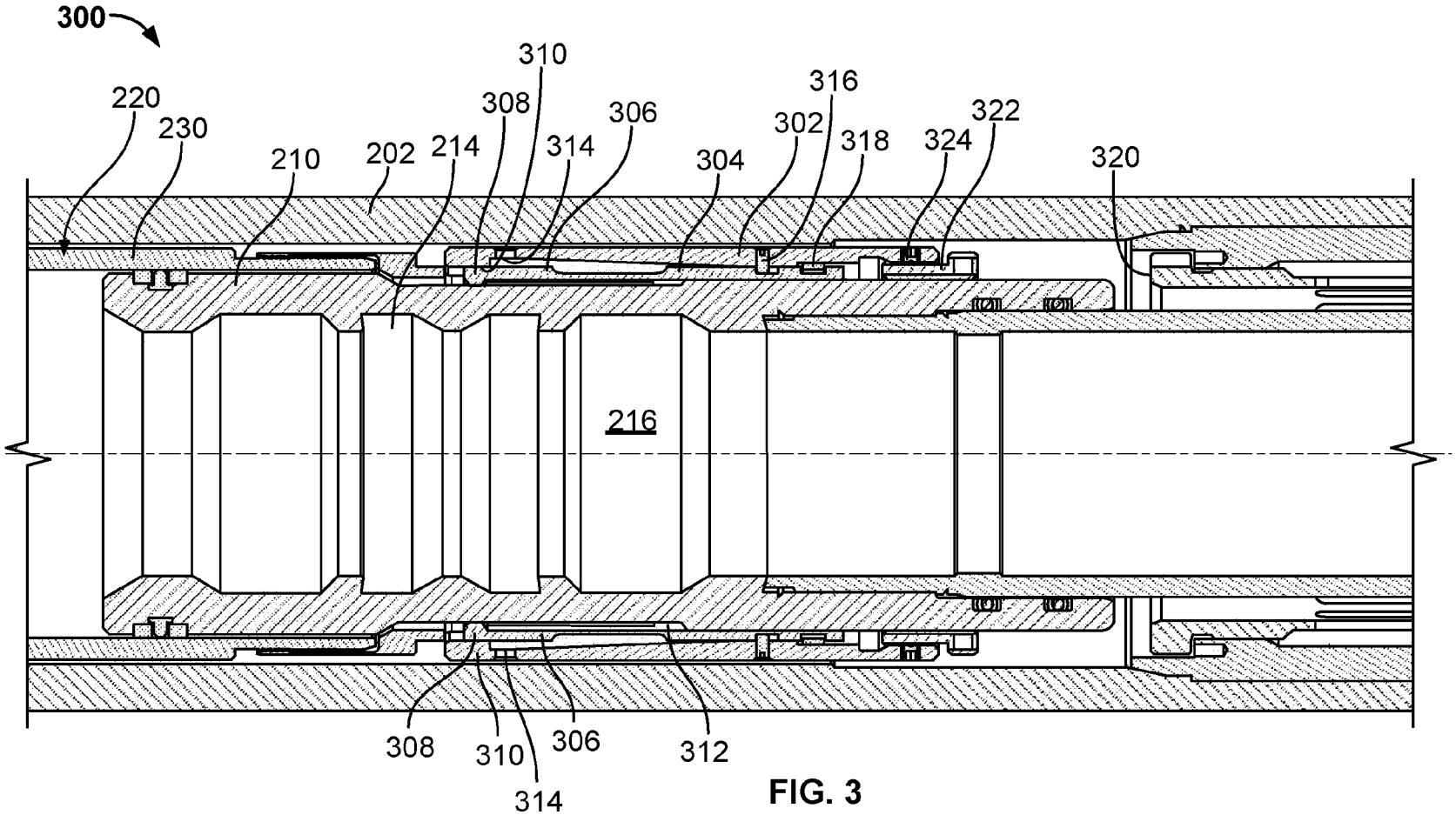
FIGS. 3, 4A and 4B are detailed views of an example releasable coupling assembly.
Figure 4A:
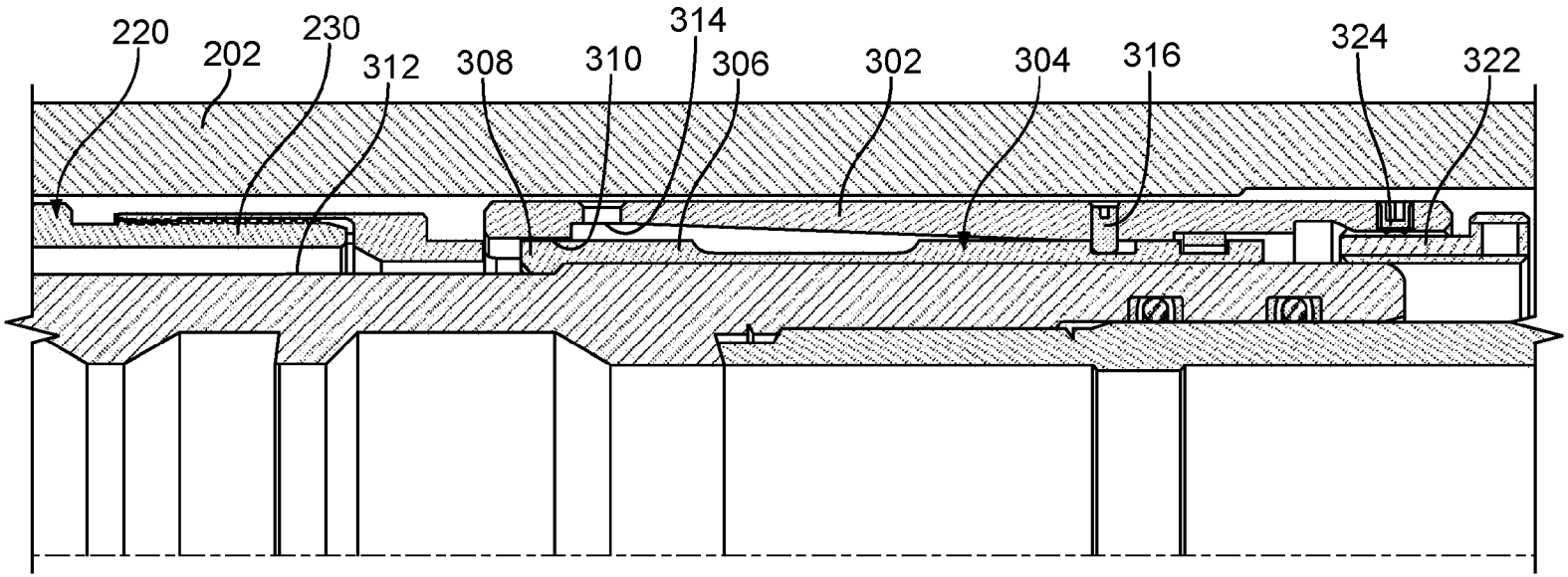
Figure 4B:
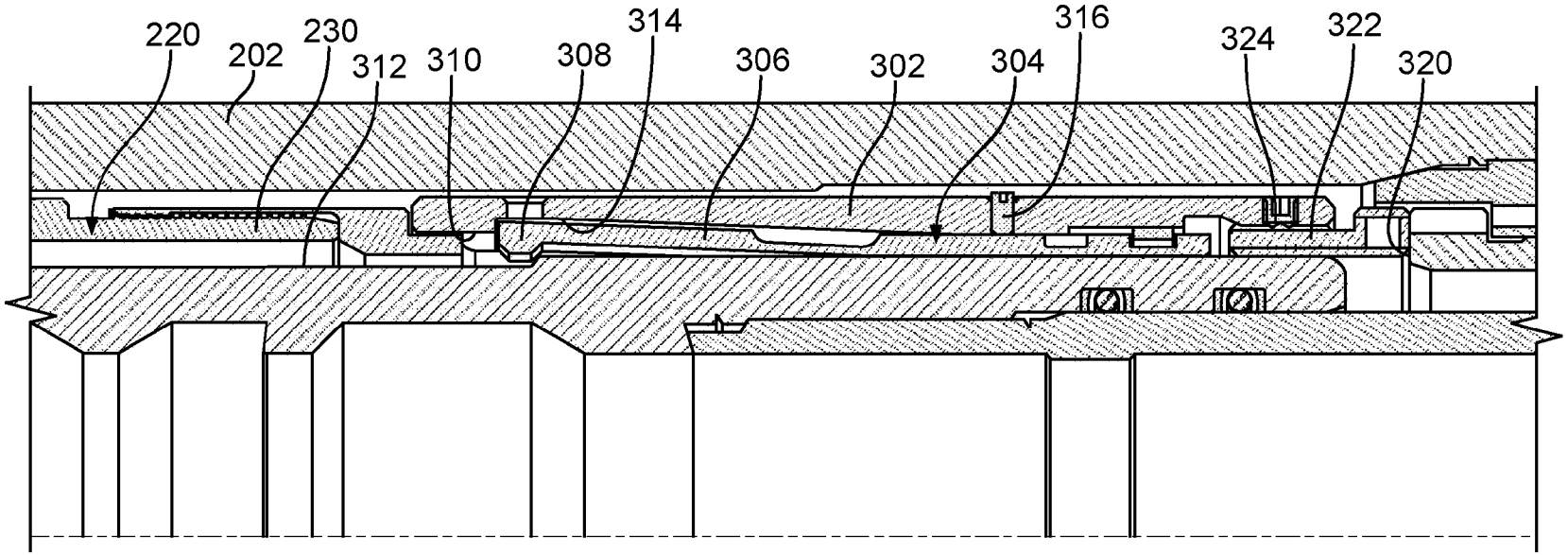

Referring now to FIGS. 3 and 4A, and 4B, an example releasable coupling assembly 300 is shown. The example releasable coupling assembly 300 can be used as releasable coupling assembly 224, and is shown in such context. FIG. 3 is a detail of the valve 200 in half cross-section with the releasable coupling assembly 300 30 incorporated therein. FIG. 3 depicts the valve 200 with the actuator assembly 220 in an ctuated unactuated state and the releasable coupling assembly 300 ready to couple the actuator sleeve 210 to the actuator assembly 220. FIG. 4A is a quarter section detail view showing the actuator assembly 220 changing to the actuated state and the releasable coupling assembly 300 coupling the actuator sleeve 210 to the actuator assembly. FIG. 4B is a quarter section 5 detail view showing the actuator assembly 220 in the actuated state and the coupling assembly 300 released not coupling the actuator sleeve 210 to the actuator assembly 220.

As seen in FIG. 3, the releasable coupling 300 includes a tubular support body 302 that is received within the housing 202 of the valve. The support body 302 internally receives a collet ring 304 that, itself, is received over the actuator sleeve 210. The collet ring 304 is affixed to the spring stop mandrel 230 of the actuator assembly 220 such that the collet ring 304 and the spring stop mandrel 230 move together. In certain instances, the end of the collet ring 304 is axially slotted and provided with ratchet threads biased to allow the end of the collet ring 304 to more deeply receive the spring stop mandrel 230 when the components are pushed axially together, yet still grip and still be threaded to allow the components to thread/unthread. Other manners of the fixing the collet ring 304 and spring stop mandrel 230 are within the concepts described herein.

The collet ring 304 includes a plurality of collet fingers 306 equally spaced around the ring 304. Each collet finger 306 has an enlarged head 308 and has a thinner section where the finger meets the remainder of the ring 304. The thinner section allows the collet fingers 306 to flex radially out of the plane of the remainder of the ring 304. The support body 302 has a support portion 310 that when radially over the enlarged heads 308 (as in FIG. 3), abuts and supports the collet fingers 306 radially inward with the heads 308 engaged in an axially elongate profile 312 of the actuator sleeve 210. The profile 312 can be single profile that spans the circumference of the actuator sleeve 210 or a plurality of grooves spaced around the circumference of the sleeve 210, and in certain instances, that correspond in number to the collet fingers 306. The support body 302 has a relief 314 adjacent to and having a larger internal diameter than the support portion 310. When the relief 314 is radially over the enlarged heads 308 (as in FIG. 4B), the collet fingers 306 are not supported radially inward and are allowed to flex radially outward. As discussed in more detail below, when the collet fingers 306 are unsupported they are able to disengage from the axially elongate profile 312. Although initially coupled with shear pin 316 (e.g., a rod, screw, or other coupling configured to release or break at a specified application of force) to the collet ring 304, once the shear pin 316 is released, the support body 302 is moveable between supporting the collet fingers 306 engaged in the axially elongate profile 312 and not supporting the collet finger 306 engaged in the axially elongate profile 312.

The valve 200 is run into position in the well, as in FIG. 3, with the actuator assembly 220 in an unactuated state. The support body 302 is affixed to the collet ring 304 by the shear pins 316 with the support portion 310 supporting the collet fingers 306 engaged in the axially elongate profile 312. In certain instances, the valve closure 204 can be fully open. When the actuator assembly 220 responds to a remote signal to actuate, the power spring drives the spring stop mandrel 230, collet ring 304 and support body 302, downhole to an actuated state. As the actuator assembly 220 changes to the actuated state, as shown in FIG. 4A, the enlarged heads 308 of the collet fingers 306 move (if they are not already) downhole to abut the downhole end of the axially elongate profile 312. Because the collet fingers 306 are supported by the support body 302 with their enlarged heads 308 engaged in the axially elongate profile 312, all (substantially or entirely) of the axial force from the actuator assembly 220 to the actuator sleeve 210 is transferred through the interface of the enlarged heads 308 and the end of the axially elongate profile 312. Thus, neither the shear pins 316 nor the support body 302 are substantially subjected to the axial force, and thus these components do not need to be sized to carry such high forces. The actuator sleeve 210 continues to move downhole with the spring stop mandrel 230, collet ring 304 and support body 302 until the valve closure 204 is moved to the fully closed position.

As the valve closure 204 reaches the fully closed position, a downhole end of the support body 302 collides with a shoulder 320 in the housing 202 (FIG. 4B). The shoulder 320 is positioned to hold the support body 302 while the collet ring 304 (driven by the power spring via the spring stop mandrel 230) continues to move downhole to a position with the enlarged heads 308 of the collet fingers 306 apart from the support portion 310 of the support body 302 and beneath the relief 314. In certain instances, the support body 302 includes an adjuster 322 that is positionable to adjust the axial position of the end of the support body 302. The adjuster allows the position at which the shoulder 320 holds the support body 302 to be adjusted. In FIGS. 3, 4A and 4B, the adjuster 322 is depicted as a sleeve threaded to the remainder of the support body 302 to thus be threaded in and out for adjustment. However, other configurations could be implemented, for example, using shims, adjustment bolts, and/or other adjustment configurations. Alternately or additionally, the adjuster 322 could be provided on the shoulder 320. In certain instances, the adjuster 322 may have a lock 324 (shown as a set screw, but other locking mechanisms could be used) to more securely affix its position.

With the end of the support body 302 abutting the shoulder 320, the collet ring 304 continues to move downhole, shears the shear pins 316 and releases the support body 302 from the collet ring 304. With the enlarged heads 308 of the collet fingers 306 beneath the relief 314, the collet fingers 306 are not radially supported and are allowed to flex radially outward. Thereafter, a shifting tool can be run into the interior of the valve 200 and engage the internal profile of the actuator sleeve 210 to operate the sleeve 210, and thus the valve closure 204, manually. The shifting tool can freely move the actuator sleeve 210 to its uphole and downhole positions, thus opening and closing the valve closure 204, as many times as is desired. Because the collet fingers 306 are not radially supported by the support body 302, they will flex outward to allow the enlarged heads 308 to exit and disengage from the axially elongate profile 312 as the actuator sleeve 210 is moved.

Notably, prior to actuating the actuator assembly 220 and with the actuator assembly 220 in the unactuated state, the valve closure 204 can be opened and closed manually with a shifting tool. The axially elongate profile 320 has a length that allows the actuator sleeve 210 to move between its uphole and downhole positions while the collet fingers 306 are engaged in the profile 320. For example, FIG. 3 shows the actuator sleeve 210 in its downhole position (e.g., corresponding to the valve closure 204 open), with the enlarged heads 308 of the collet fingers 306 intermediate the axially elongate profile 320. The actuator sleeve 210 can be moved to its uphole position (e.g., corresponding to the valve closure 204 closed) without releasing the collet fingers 306 from the profile 320. Thus, the shifting tool can freely move the actuator sleeve 210 to its uphole and downhole positions, opening and closing the valve closure 204, as many times as is desired.

A number of examples have been described. Nevertheless, it will be understood that various modifications may be made. Accordingly, other examples are within the scope of the following claims.

What is claimed is:

1. A well tool, comprising:

a housing;

an actuator sleeve in the housing, the actuator sleeve having an internal shifting tool engaging profile;

an actuator in the housing, the actuator responsive to a remote signal to change from an unactuated state to an actuated state and shift the actuator sleeve from a first position to a second position;

a collet ring in the housing that comprises a plurality of collet fingers, the collet fingers supported to couple the actuator sleeve to the actuator while the actuator changes from the unactuated state to the actuated state and unsupported to allow the actuator sleeve to move relative to the actuator when the actuator is in the actuated state, the collet fingers supported in an axially elongate profile of the actuator sleeve while the actuator changes from the unactuated state to the actuated state, and an end of the axially elongate profile abuts the collet fingers and transfer loads from the actuator, through the collet fingers, to the actuator sleeve as the actuator changes from the unactuated state to the actuated state; and a tubular support body moveable between supporting the collet fingers engaged in the axially elongate profile and not supporting the collet fingers engaged in the axially elongate profile.

2. The well tool of claim 1, further comprising a valve closure and where the actuator sleeve is coupled to the valve closure and operates the valve closure between an open and closed state when the actuator sleeve is moved between the first position and the second position.

3. The well tool of claim 1, where, with the actuator in the unactuated state, the collet fingers are supported to couple the actuator sleeve to the actuator while allowing the actuator sleeve to move between the first position and the second position.

4. The well tool of claim 1, where the axially elongate profile has a length that allows the actuator sleeve to move between the first position and the second position while the collet fingers are supported in the axially elongate profile.

5. The well tool of claim 1, where the well tool further comprises a shoulder in the housing positioned to abut the support body when the actuator is in the actuated position and position the support body not supporting the collet engaged in the axially elongate profile.

6. The well tool of claim 5, where the support body comprises an adjuster positionable to the axial position of an end of the support body that abuts the shoulder.

7. The well tool of claim 5, further comprising a coupling that couples the support body to the collet positioned supporting the collet fingers in engagement with the axially elongate profile until the support body abuts the shoulder.

8. The well tool of claim 7, where the coupling comprises a shear pin.

9. The well tool of claim 1, where the collet ring is carried to move with the actuator.

10. The well tool of claim 1, where substantially all axial loads applied by the actuator to the actuator sleeve are transferred through the collet ring.

11. The well tool of claim 1, where an enlarged head of each collet finger is supported in the axially elongate profile of the actuator sleeve while the actuator changes from the unactuated state to the actuated state, and the end of the axially elongate profile abuts the enlarged head of the collet finger and transfer loads from the actuator, through the collet finger, to the actuator sleeve as the actuator changes from the unactuated state to the actuated state.

12. The well tool of claim 11, where each collet finger comprises a thinner section that allows the collet finger to radially flex outward.

13. The well tool of claim 1, where the tubular support body is positioned radially between the housing and the collet ring.

14. A method of actuating a well tool, comprising:

supporting a collet finger of a collet ring to couple an actuator to an actuator sleeve while moving the actuator sleeve axially relative to the actuator;

operating the actuator to axially move the actuator sleeve while the collet finger is coupling the actuator to the actuator sleeve; and then, unsupporting the collet finger to allow the actuator sleeve to uncouple from the actuator after operation of the actuator.

15. The method of claim 14, further comprising, after unsupporting the collet finger, moving the actuator sleeve axially relative to the actuator.

16. The method of claim 14, where the collet ring comprises a plurality of collet fingers and operating the actuator to axially move the actuator sleeve comprises transferring substantially all axial loads applied by the actuator to the actuator sleeve through the collet ring.

17. The method of claim 14, where axially moving the actuator sleeve moves a valve closure of the tool between an open and closed state.

18. The method of claim 14, where operating the actuator to axially move the actuator sleeve while the collet ring is coupling the actuator to the actuator sleeve comprises:

generating a signal to the actuator from a location remote from the well tool;

transmitting the signal to the actuator; and based on the transmitted signal, axially moving the actuator sleeve.

19. The method of claim 18, where the signal comprises a hydraulic signal, and transmitting the signal to the actuator comprises providing the hydraulic signal at a specified number of pressure cycles in a bore that is hydraulically coupled to the well tool.

20. The method of claim 19, further comprising operating a valve in the bore to generate the specified number of pressure cycles.

21. The method of claim 14, where unsupporting the collet finger to allow the actuator sleeve to uncouple from the actuator comprises:

moving a tubular support body from supporting the collet finger engaged in an axially elongate profile of the actuator sleeve to not supporting the collet finger engaged in the axially elongate profile; and abutting a shoulder in the housing with the support body after operating the actuator so that the tubular support body is not supporting the collet finger engaged in the axially elongate profile.

22. A device for use in a subterranean well, the device comprising:

an actuator responsive to actuate in response to a signal generated remote from the device;

an actuator sleeve coupled to an actuated element of the device to operate the actuated element when the actuator shifts axially in the device; and a collet ring comprising a plurality of collet fingers that couples the actuator to the actuator sleeve to move the actuator sleeve when the actuator actuates, that allows the actuator sleeve to operate the actuated element when the actuator is coupled to the actuator sleeve without operating the actuator, and that allows the actuator to uncouple from the actuator sleeve when the actuator has been remotely actuated, substantially all axial loads applied by the actuator to the actuator sleeve transferred through the collet fingers, where the collet fingers engage in an axially elongate profile in the actuator sleeve and abut an end of the axially elongate profile when the actuator moves the actuator sleeve and translates in the axially elongate profile when the actuator sleeve operates the actuated element without the actuator operating.

23. The device of claim 22, where the actuated element comprise a valve closure.

24. The device of claim 22, where the signal generated remote from the device comprises a hydraulic signal at a specified number of pressure cycles.

25. The device of claim 24, where the actuator is in hydraulic communication with a bore, and a valve is disposed in the bore to produce the hydraulic signal at the specified number of pressure cycles.

26. The device of claim 22, further comprising:

a housing;

a tubular support body positioned between the collet ring and the housing and moveable between supporting the collet fingers engaged in the axially elongate profile and not supporting the collet fingers engaged in the axially elongate profile; and a shoulder in the housing arranged to abut the support body when the actuator has been remotely actuated and position the support body not supporting the collet fingers engaged in the axially elongate profile.

* * * * *